US010172459B2

(12) United States Patent
Chen et al.

(10) Patent No.: US 10,172,459 B2
(45) Date of Patent: Jan. 8, 2019

(54) SYNCHRONIZATION SYSTEM FOR SLIDE RAIL ASSEMBLY AND FURNITURE SYSTEM THEREWITH

(71) Applicants: KING SLIDE WORKS CO., LTD., Kaohsiung (TW); KING SLIDE TECHNOLOGY CO.,LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/653,551

(22) Filed: Jul. 19, 2017

(65) Prior Publication Data

US 2018/0263369 A1 Sep. 20, 2018

(30) Foreign Application Priority Data

Mar. 20, 2017 (TW) ..... 106109440 A

(51) Int. Cl.
*A47B 88/45* (2017.01)
*A47B 88/47* (2017.01)
(Continued)

(52) U.S. Cl.
CPC ..... *A47B 88/45* (2017.01); *A47B 88/437* (2017.01); *A47B 88/463* (2017.01); *A47B 88/47* (2017.01);
(Continued)

(58) Field of Classification Search
CPC ..... Y10T 292/093; Y10T 292/0932; Y10T 292/0947; Y10T 292/0949;
(Continued)

(56) References Cited

U.S. PATENT DOCUMENTS 4,925,258 A * 5/1990 Ludwig ..... A47B 88/9412 211/184
5,226,714 A * 7/1993 Wright ..... A47B 88/48 312/323
(Continued)

FOREIGN PATENT DOCUMENTS

AT 507656 * 5/2009
AT 511938 * 4/2013
(Continued)

*Primary Examiner* — Janet M Wilkens
(74) *Attorney, Agent, or Firm* — Winston Hsu

(57) ABSTRACT

A synchronization system, which includes a synchronization device, is applicable to a slide rail and an opening mechanism. The opening mechanism includes an elastic member and a locking member configured to lock the elastic member. The synchronization device includes a housing and a driving member. The housing is mounted to the slide rail. The driving member is movable relative to the housing. The driving member is configured to drive the locking member to move for unlocking the elastic member, in order to allow the elastic member to release an elastic force to be applied to the slide rail.

18 Claims, 17 Drawing Sheets

(51) Int. Cl.
*A47B 88/437* (2017.01)
*A47B 88/463* (2017.01)
*A47B 88/423* (2017.01)

(52) U.S. Cl.
CPC ..... *A47B 2088/4235* (2017.01); *A47B 2210/0078* (2013.01)

(58) Field of Classification Search
CPC ..... Y10T 292/1039; Y10T 292/10395; Y10T 292/1054; Y10T 292/1055; Y10T 292/1056; Y10T 292/1059; Y10T 292/1077; Y10T 292/108; Y10T 403/39; Y10T 403/3933; Y10T 403/3946; Y10T 403/3981; E05C 3/00; E05C 3/004; E05C 3/06; E05C 3/12; E05C 3/16; E05C 3/165; A47B 88/45; A47B 88/47; A47B 88/437; A47B 2088/4235; A47B 2210/0078
USPC ..... 312/331, 334.6, 333
See application file for complete search history.

(56) References Cited

U.S. PATENT DOCUMENTS 8,534,781 B2 9/2013 Netzer
8,833,879 B2 * 9/2014 Netzer ..... A47B 88/0418 312/333
8,911,038 B2 * 12/2014 Gmeiner ..... A47B 88/047 312/331
8,931,863 B2 * 1/2015 Vulava ..... F24C 15/162 312/402
8,950,833 B2 2/2015 Bohle
9,016,813 B2 * 4/2015 Moody ..... F25D 25/025 312/331
9,565,937 B1 * 2/2017 Jansen ..... F25D 25/025
9,681,748 B2 * 6/2017 Chen ..... A47B 88/453
9,801,468 B2 * 10/2017 Hashemi ..... A47B 88/40
2010/0219727 A1 9/2010 Aguilar Ante
2013/0334946 A1 12/2013 Netzer
2017/0095084 A1 * 4/2017 Koenig ..... A47B 88/463

FOREIGN PATENT DOCUMENTS

| | | | |
|---|---|---|---|
| AT | 512934 | * | 12/2013 |
| AT | 514865 | * | 4/2015 |
| AT | 14687 | * | 4/2016 |
| CA | 2757890 | * | 5/2012 |
| DE | 202012003004 | * | 6/2013 |
| DE | 202012002378 | * | 8/2013 |
| DE | 202012003537 | * | 9/2013 |
| DE | 202012008995 | * | 1/2014 |
| DE | 102014107692 | * | 12/2015 |
| DE | 20 2015 106 773 U1 | | 3/2017 |
| EP | 2025262 | * | 2/2009 |
| JP | 2011-514218 A | | 5/2011 |
| WO | 2010129303 | * | 11/2010 |
| WO | 2011075753 | * | 6/2011 |
| WO | 2015192153 A1 | | 12/2015 |
| WO | 20151922153 | * | 12/2015 |

* cited by examiner

SYNCHRONIZATION SYSTEM FOR SLIDE RAIL ASSEMBLY AND FURNITURE SYSTEM THEREWITH

BACKGROUND OF THE INVENTION

1. Field of the Invention

The present invention relates to a synchronization system, and more particularly, to a synchronization system allowing two slide rail assemblies to be moved synchronously.

2. Description of the Prior Art

In a furniture system, such as a cabinet system, a drawer usually can be opened or retracted relative to a cabinet through a pair of slide rail assemblies. A product capable of assisting in opening a drawer from a retracted position relative to a cabinet is already provided in current market, and the product is so called a push-open product. US patent publication number 2012/0038255 A1 discloses an ejection device for a furniture part. Specifically, an arrangement comprising two ejection devices (1, 2) arranged at both sides of a movable furniture part (5), and spring-loaded ejectors (13) are disclosed. Wherein, the ejection devices (1, 2) comprise a latching element (18) configured to be temporarily locked at a position (E) through a heart curve-shaped slotted guide path (10), and the ejection devices (1, 2) can be unlocked by pressing the movable furniture part (5). Wherein, guide carriages (17) of the two ejection devices (1, 2) are connected to each other through a synchronization rod (6). The case is provided for reference.

SUMMARY OF THE INVENTION

The present invention relates to a synchronization system allowing two slide rail assemblies to be moved synchronously.

According to an embodiment of the present invention, a synchronization system is applicable to a furniture system. The synchronization system comprises a first synchronization device detachably connected to a first slide rail assembly of the furniture system; a second synchronization device detachably connected to a second slide rail assembly of the furniture system, wherein each of the first slide rail assembly and the second slide rail assembly comprises a first rail and a second rail movable relative to the first rail; and a synchronization rod detachably mounted between the first synchronization device and the second synchronization device for allowing the second rail of the first slide rail assembly and the second rail of the second slide rail assembly to move synchronously.

Preferably, the first slide rail assembly comprises an opening mechanism. The opening mechanism comprises an elastic member and a locking member configured to lock the elastic member. The first synchronization device comprises a housing and a driving member mounted to the housing. The driving member is configured to drive the locking member to move for unlocking the elastic member in response to the second rail moving relative to the first rail from a predetermined position along a first direction, in order to allow the elastic member to release an elastic force for driving the second rail of the first slide rail assembly and the second rail of the second slide rail assembly to move along a second direction opposite to the first direction.

Preferably, the driving member comprises an elastic feature. The driving member is held in an initial state relative to the housing in response to an elastic force of the elastic feature.

Preferably, the first synchronization device further comprises an actuating member. During the process of the second rail moving relative to the first rail from the predetermined position along the first direction, the actuating member abuts against a portion of the first rail to generate an action force to be applied to the driving member, such that the driving member is no longer in the initial state and configured to drive the locking member in response to the action force.

Preferably, the housing comprises a first side plate and a second side plate connected to the first side plate. The driving member and the actuating member are movably mounted to the first side plate and the second side plate respectively.

Preferably, the driving member and the actuating member are respectively pivoted to the first side plate and the second side plate. The driving member is movable relative to the first side plate within a limited range defined by a first limiting feature, and the actuating member is movable relative to the second side plate within a limited range defined by a second limiting feature.

Preferably, the first synchronization device further comprises a supporting base connected to the actuating member. The synchronization rod is detachably connected to the supporting base.

According to another embodiment of the present invention, a synchronization device is applicable to a furniture system. The synchronization device comprises a housing; and a driving member movable relative to the housing. The furniture system comprises a first slide rail assembly having a first rail, a second rail and an opening mechanism. The second rail is movable relative to the first rail. The opening mechanism comprises an elastic member and a locking member configured to temporarily lock the elastic member. The housing is detachably connected to the second rail. The driving member is configured to drive the locking member to move for unlocking the elastic member in response to the second rail moving relative to the first rail from a predetermined position along a first direction, in order to allow the elastic member to release an elastic force for driving the second rail to move relative to the first rail along a second direction.

According to another embodiment of the present invention, a synchronization device comprises a housing configured to be mounted to a slide rail, wherein the slide rail comprises an opening mechanism, the opening mechanism comprises an elastic member and a locking member configured to lock the elastic member; and a driving member movable relative to the housing, the driving member configured to drive the locking member to move for unlocking the elastic member, in order to allow the elastic member to release an elastic force to be applied to the slide rail.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
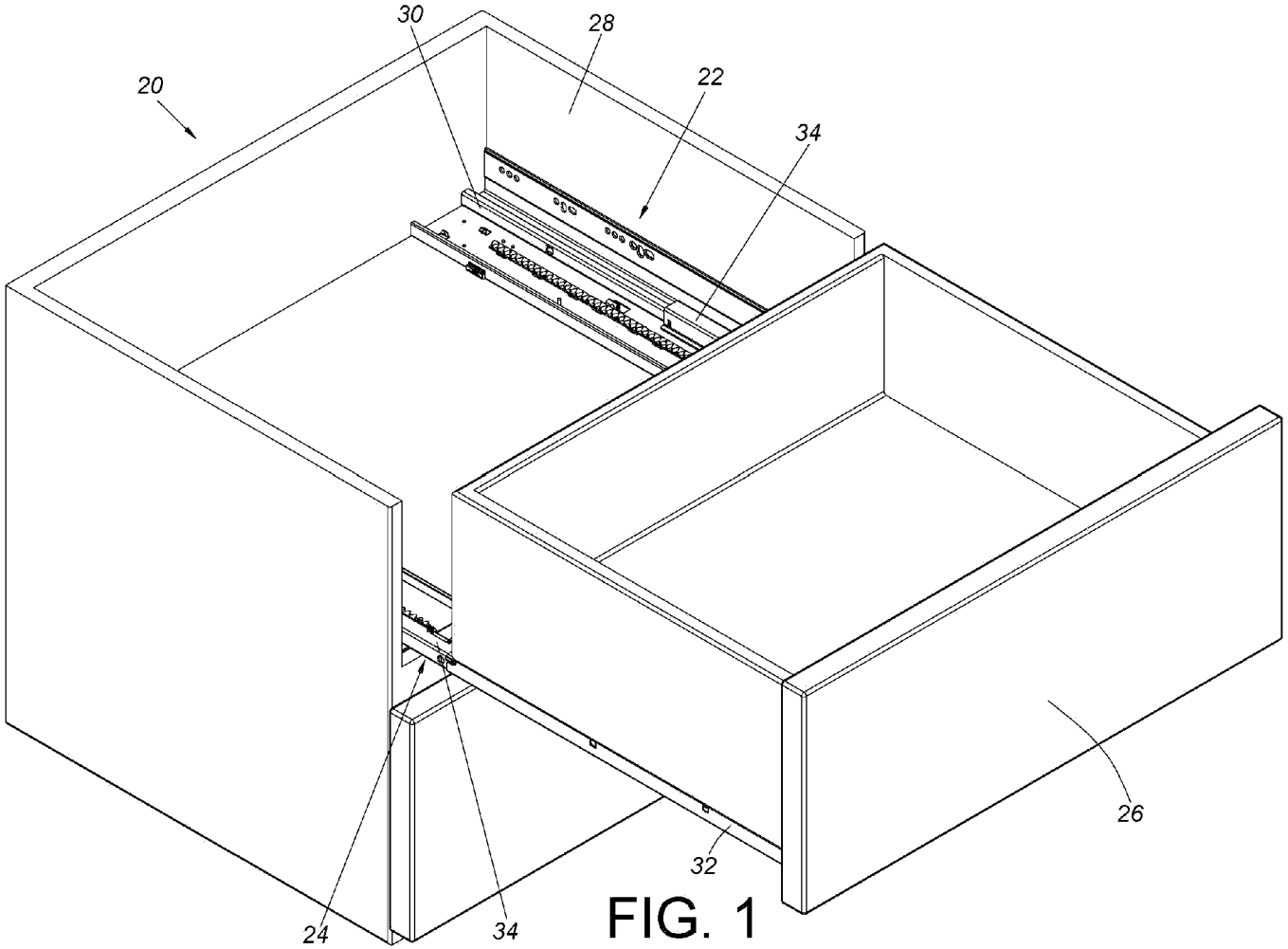
FIG. 1 is a diagram showing a furniture system comprising two first furniture parts and a second furniture part according to an embodiment of the present invention.

As shown in FIG. 1, a furniture system 20 comprises a first slide rail assembly 22 and a second slide rail assembly 24. The first slide rail assembly 22 and the second slide rail assembly 24 allows a first furniture part 26 to be easily moved relative to a second furniture part 28. Wherein, the first furniture part 26 can be a drawer and the second furniture part 28 can be a cabinet, but the present invention is not limited thereto.

Figure 2:
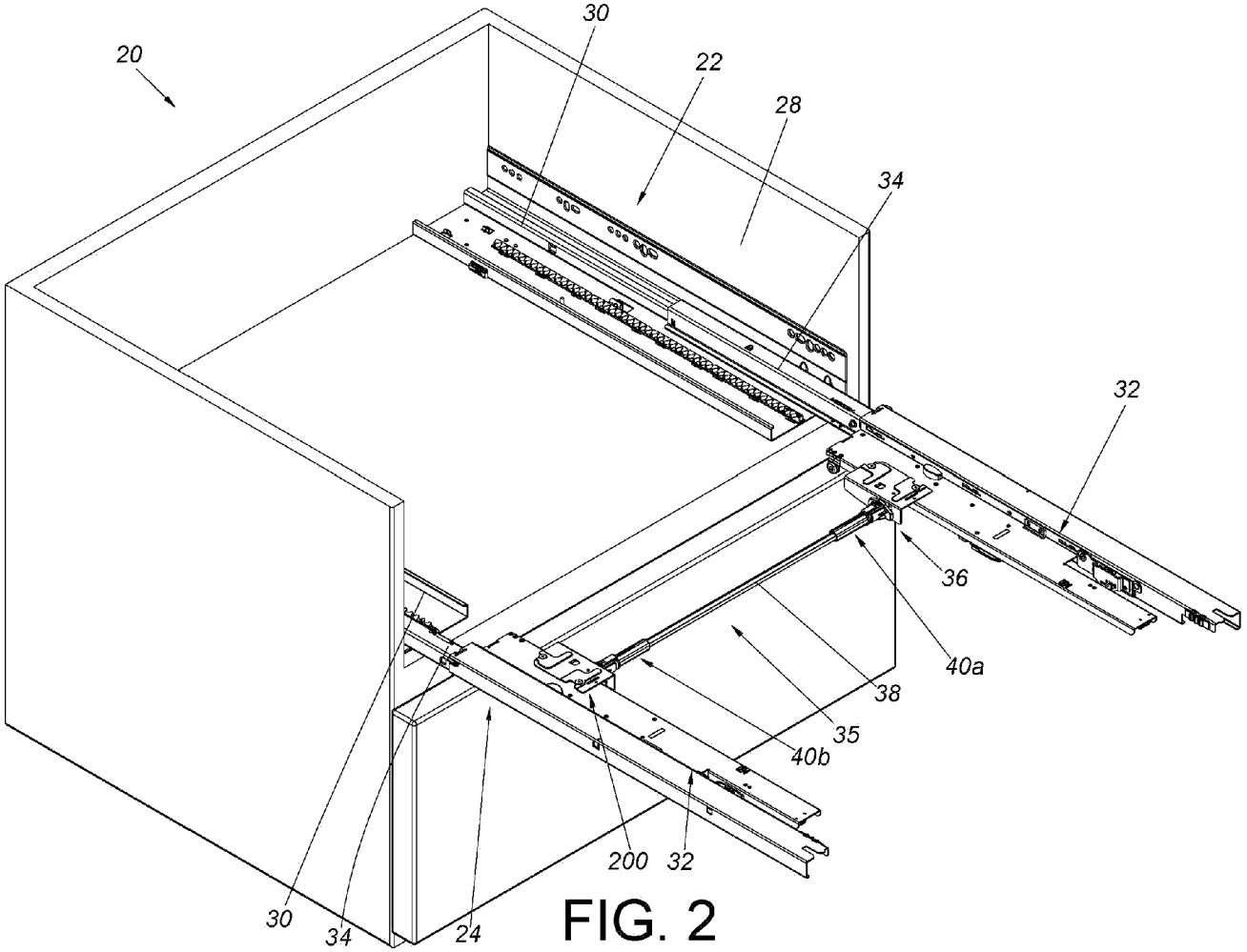
FIG. 2 is a diagram showing the furniture system of FIG. 1 without one of the first furniture parts according to an embodiment of the present invention, wherein a synchronization system is mounted between two slide rail assemblies.

As shown in FIG. 2, structural arrangement of the first slide rail assembly 22 is substantially identical to structural arrangement of the second slide rail assembly 24. In particular, each of the first slide rail assembly 22 and the second slide rail assembly 24 comprises a first rail 30 and a second rail 32 movable relative to the first rail 30. Preferably, each of the first slide rail assembly 22 and the second slide rail assembly 24 further comprises a third rail 34 movably mounted between the first rail 30 and the second rail 32 for extending a traveling distance of the second rail 32 relative to the first rail 30. Wherein, the first rail 30 is fixedly mounted to the second furniture part 28, and the second rail 32 is configured to carry the first furniture part 26 (please refer to FIG. 1). A synchronization system 35 of the present invention, which comprises a first synchronization device 36 and a second synchronization device 200, is applicable to the furniture system 20. For example, the first synchronization device 36 is arranged on the first slide rail assembly 22, and the second synchronization device 200 is arranged on the second slide rail assembly 24, such that the second rail 32 of the first rail assembly 22 and the second rail 32 of the second rail assembly 24 can be moved synchronously, in order to improve stability of the two second rails 32 during moving. The synchronization system 35 of the present invention further comprises a synchronization rod 38 detachably mounted between the first synchronization device 36 and the second synchronization device 200. The synchronization rod 38 is detachably connected to the first synchronization device 36 and the second synchronization device 200 through a first connecting base 40*a* and a second connecting base 40*b* respectively. In the present embodiment, since the first synchronization device 36 and the second synchronization device 200 are symmetrically arranged, components and arrangement of the second synchronization device 200 are similar to components and arrangement of the first synchronization device 36. For simplification, only the components and arrangement of the first synchronization device 36 are illustrated. However, in other embodiments, the components and arrangement of the second synchronization device 200 can be different from the components and arrangement of the first synchronization device 36.

Figure 3:
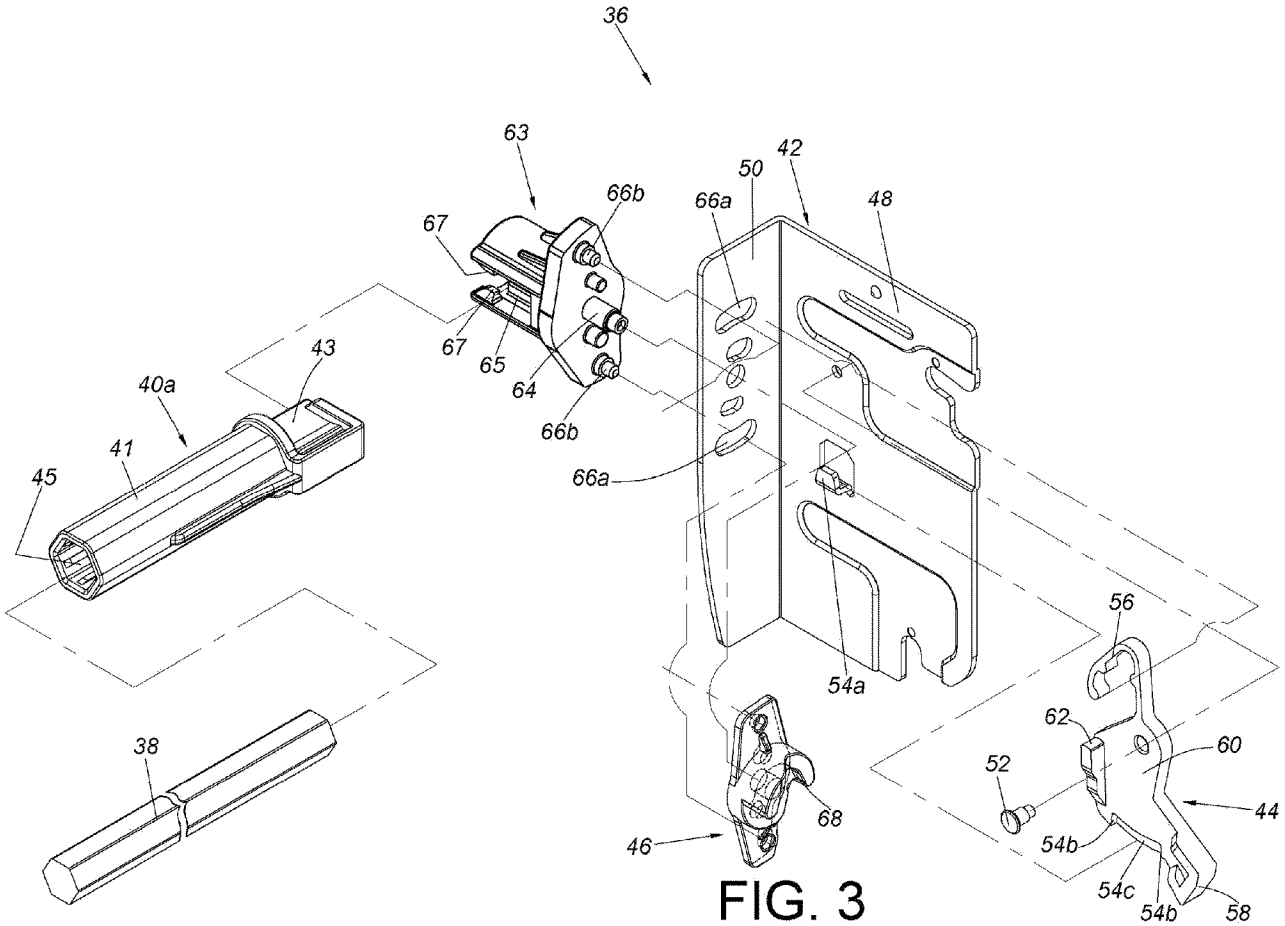
FIG. 3 is an exploded view of a synchronization device according to an embodiment of the present invention.
Figure 4:
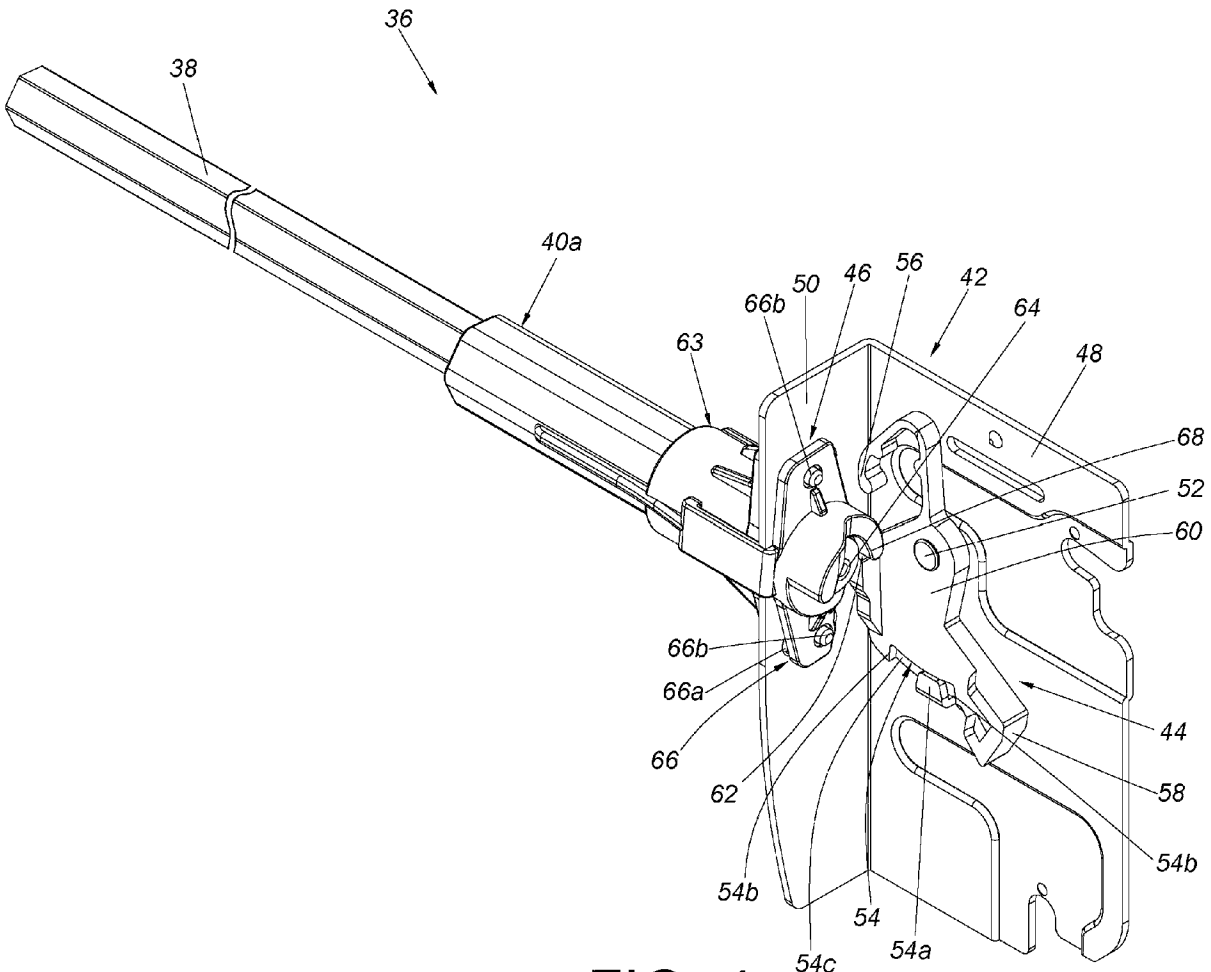
FIG. 4 is a diagram showing the synchronization device according to an embodiment of the present invention.

As shown in FIG. 3 and FIG. 4, the first synchronization device 36 comprises a housing 42 and a driving member 44. Preferably, the first synchronization device 36 further comprises an actuating member 46.

The housing 42 comprises a first side plate 48 and a second side plate 50 connected to the first side plate 48. Preferably, the second side plate 50 is perpendicularly bent relative to the first side plate 48. Or, the second side plate 50 is substantially perpendicularly connected to the first side plate 48.

The driving member 44 is movable relative to the housing 42. In the present embodiment, the driving member 44 is movably mounted to the housing 42. Preferably, the driving member 44 is pivoted to the first side plate 48 of the housing 42 by a shaft member 52, and the driving member 44 is movable relative to the first side plate 48 within a limited range defined by a first limiting feature 54. In the present embodiment, the first side plate 48 of the housing 42 has an L-shaped protrusion 54*a*, and the driving member has two walls 54*b* and a concave part 54*c* arranged between the two walls 54*b*. The protrusion 54*a*, the two walls 54*b* and the concave part 54*c* form the first limiting feature 54. Wherein, the concave part 54*c* is configured to accommodate the protrusion 54*a*. Preferably, the concave part 54*c* is substantially arranged in a curved shape, and the concave part 54*c* is larger than the protrusion 54*a*. In an alternative embodiment, the first side plate 48 of the housing 42 can have the two walls 54*b* and the concave part 54*c* arranged between the two walls 54*b*, and the driving member 44 can have the protrusion 54*a*. However, the arrangement for allowing the driving member 44 to be movable relative to the first side plate 48 of the housing 42 within a limited range is not limited by the above embodiments. Furthermore, the driving member 44 comprises an elastic feature 56, a driving feature 58 and a main body part 60 arranged between the elastic feature 56 and the driving feature 58. Wherein, the main body part 60 is pivoted to the first side plate 48 of the housing 42 by the shaft member 52. The main body part 60 has a contact wall 62. Preferably, the elastic feature 56 and the driving feature 58 are connected to the main body part 60, and the elastic feature 56, such as an elastic leg, faces toward and contacts the second side plate 50 of the housing 42, such that the driving member 44 can be held in an initial state, such as being held at an initial position relative to the housing 42, in response to the elastic force of the elastic feature 56. Preferably, the driving member 44 is made of a flexible material, such as a plastic material, and the elastic feature 56, the driving feature 58 and the main body part 60 are integrally formed in one piece.

The actuating member 46 is movable relative to the housing 42. In the present embodiment, the actuating member 46 is movably mounted to the housing 42 and adjacent to the driving member 44. Preferably, the first synchronization device 36 further comprises a supporting base 63 connected to the actuating member 46, and the actuating member 46 and the supporting base 63 are movably mounted to the second side plate 50 of the hosing 42 and respectively located at two opposite sides of the second side plate 50. In particular, the actuating member 46 and the supporting base 63 are pivoted to the second side plate 50 of the housing 42 by a pivoting member 64, and the actuating member 46 and the supporting base 63 are movable relative to the second side plate 50 within a limited range defined by a second limiting feature 66. In the present embodiment, the second side plate 50 of the housing 42 has at least one elongated hole 66*a*, and one of the actuating member 46 and the supporting base 63 is arranged with at least one pin member 66*b* configured to penetrate through a portion of the at least one elongated hole 66*a*. The at least one elongated hole 66*a* and the at least one pin 66*b* form the second limiting feature 66. Preferably, the at least one elongated hole 66*a* is substantially arranged in a curved shape. In an alternative embodiment, the second side plate 50 of the housing 42 can have the pin member 66*b*, and each of the actuating member 46 and the supporting base 63 can have the elongated hole 66*a*. However, the arrangement for allowing the actuating member 46 and the supporting base 63 to be movable relative to the second side plate 50 of the housing 42 within a limited range is not limited by the above embodiments. Preferably, the actuating member 46 has an actuating part 68. The actuating part 68 is arranged at a position corresponding to the contact wall 62 of the driving member 44. Preferably, the synchronization rod 38 has a non-circular contour, such as a polygonal contour. The synchronization rod 38 is detachably connected to the supporting base 63 through the first connecting base 40*a*. In detail, the first connecting base 40*a* has a body part 41 and a head part 43 connected to the body part 41. The body part 41 has an accommodating room 45 corresponding to the contour of the synchronization rod 38, such that the synchronization rod 38 can be inserted into the accommodating room 45 for connection. The head part 43 has a non-circular shape, such as a rectangle shape. The supporting base 63 has a notch 65 for mounting the head part 63 therein. A pair of clamping parts 67 is extended from two sides of the notch 65 for clamping the head part 43, such that the first connecting base 40*a* can be detachably connected to the supporting base 63.

Figure 5:
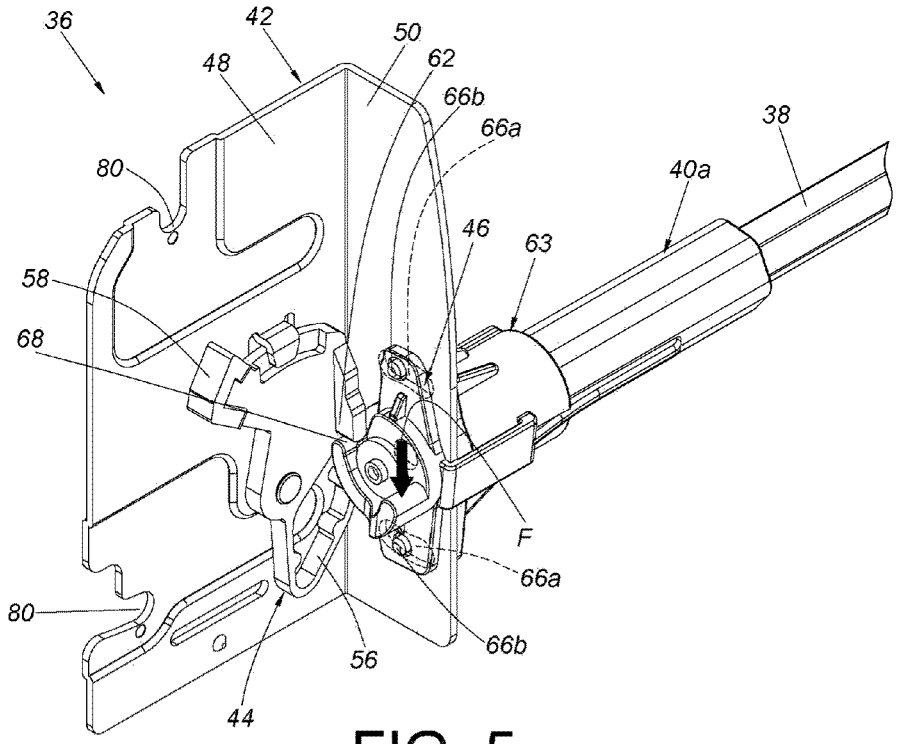
FIG. 5 is a diagram showing the synchronization device before being operated according to an embodiment of the present invention.
Figure 6:
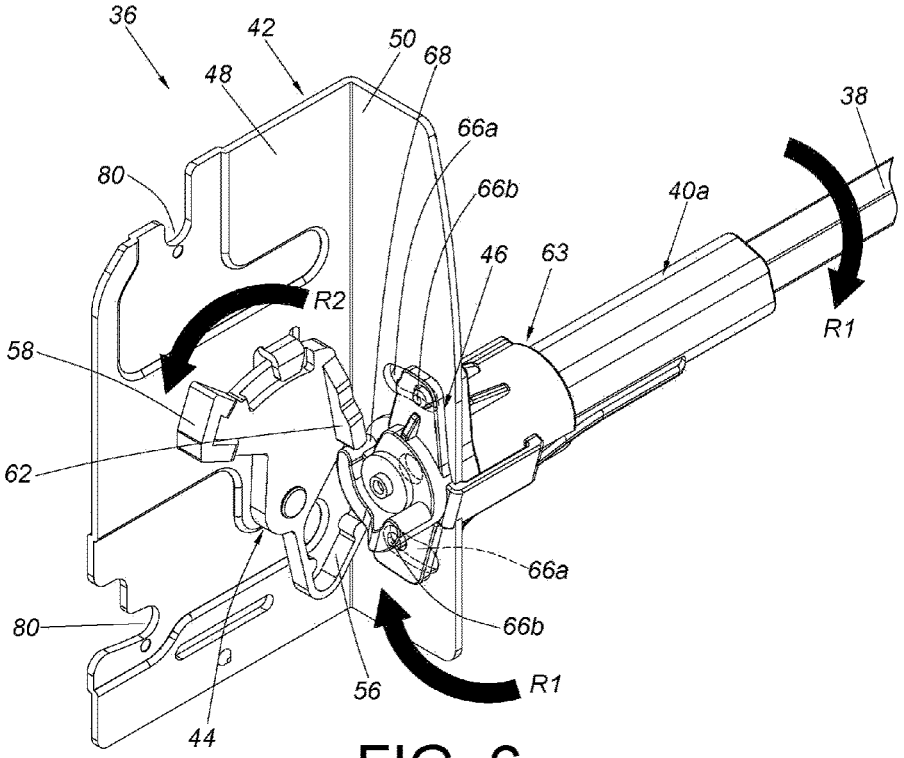
FIG. 6 is a diagram showing the synchronization device after being operated according to an embodiment of the present invention.

As shown in FIG. 5 and FIG. 6, when a force F is applied to the actuating member 46, the actuating member 46 is rotated relative to the second side plate 50 of the housing 42 along a first rotation direction R1, and the actuating member 46 further pushes the contact wall 62 of the driving member 44 through the actuating part 68, such that the driving member 44 is rotated relative to the first side plate 48 of the housing 42 along a second rotation direction R2 in response to the force F. That is, the driving member 44 is driven by the actuating member 46 to be no longer in the initial state. Meanwhile, the elastic feature 56 abuts against the second side plate 50 of the housing 42 in response to the force F, in order to accumulate an elastic force (as shown in FIG. 6). In response to the actuating member 46 being rotated along the first rotation direction R1, the supporting base 63 and the synchronization rod 38 are also rotated along the first rotation direction R1. Furthermore, when the force F is no longer applied to the actuating member 46, the elastic feature 56 releases the elastic force immediately, such that the driving member 44 is once again held in the initial state relative to the first side plate 48 of the housing 42 in response to the elastic force of the elastic feature 56 (as shown in FIG. 5).

Figures 7, 9:
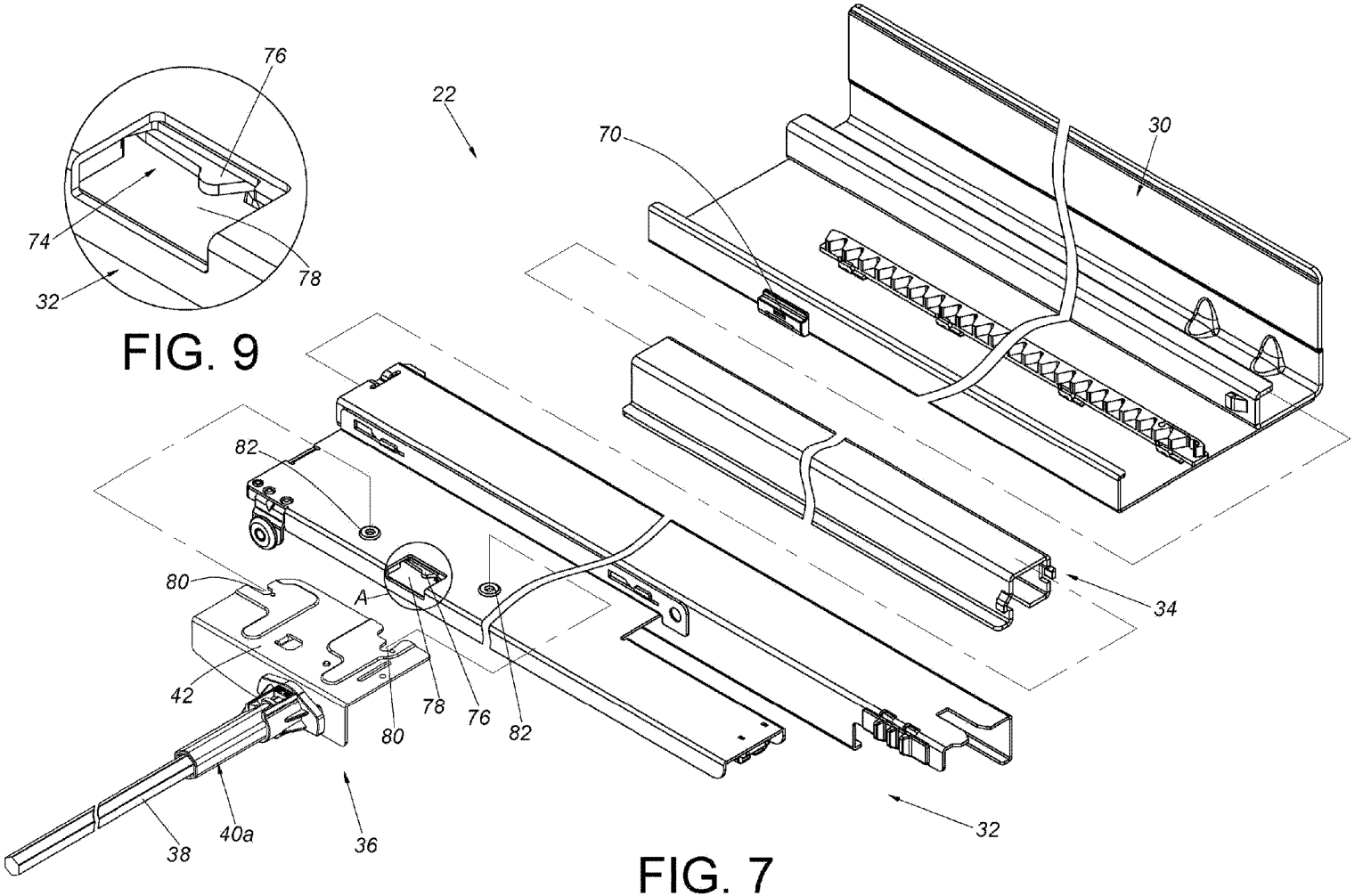
FIG. 7 is an exploded view of the slide rail assembly according to an embodiment of the present invention.
FIG. 9 is an enlarged view of an area A of FIG. 7.
Figure 8:
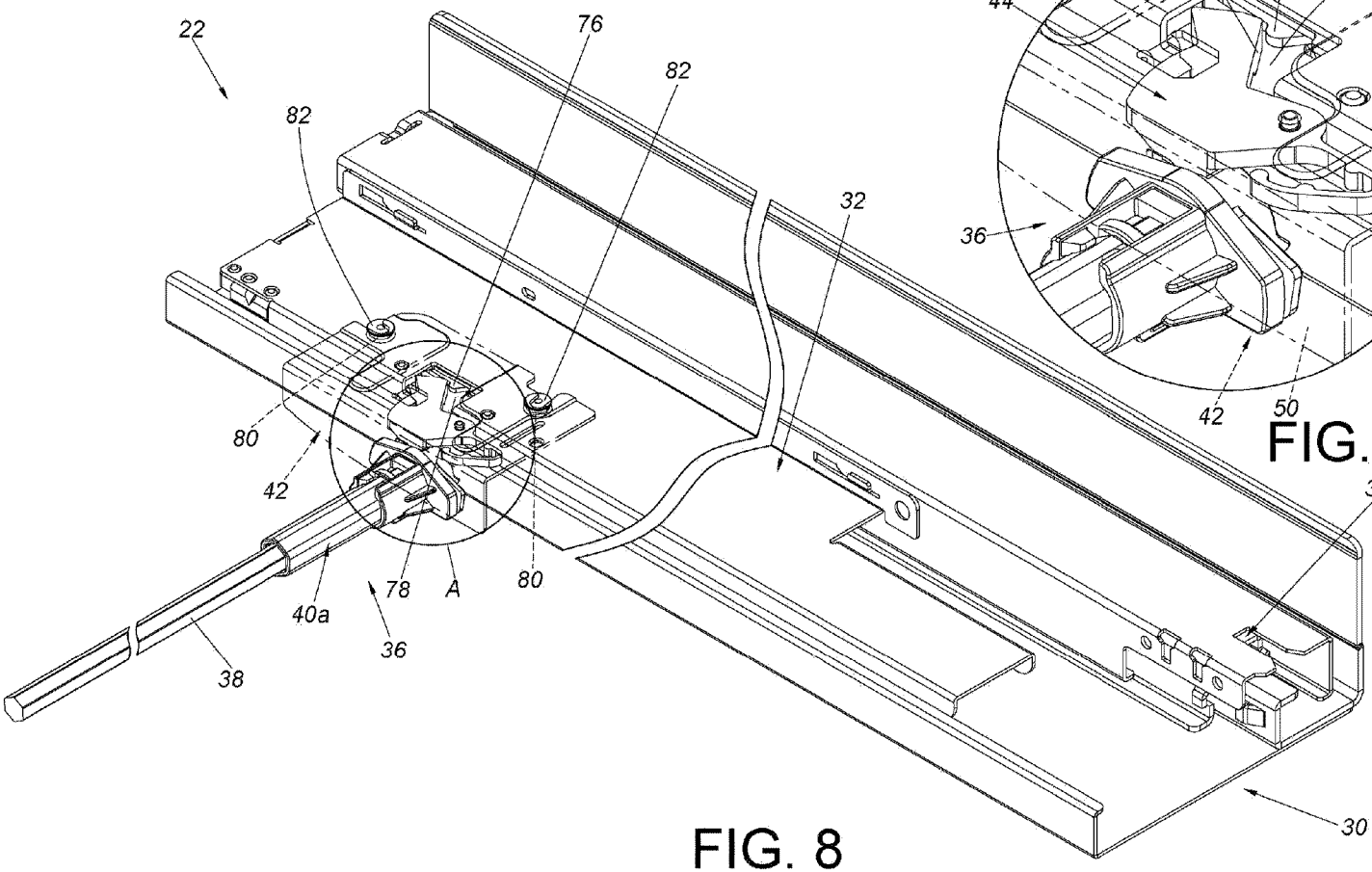
FIG. 8 is a diagram showing the slide rail assembly according to an embodiment of the present invention.

As shown in FIG. 7 and FIG. 8, the first slide rail assembly 22 comprises the first rail 30, the second rail 32 and the third rail 34. Preferably, the first rail 30 has a blocking feature 70, such as a protrusion block or an extension wall. The blocking feature 70 can be integrally formed on the first rail 30 of the first slide rail assembly 22, or can be an additional component attached to the first rail 30 of the first slide rail assembly 22, such that the blocking feature 70 can be seen as a portion of the first rail 30. Preferably, the first slide rail assembly 22 further comprises an opening mechanism 74 (please refer to FIG. 9). In the present embodiment, the opening mechanism 74 is attached to the second rail 32 and comprises a locking member 76. Preferably, the second rail 32 has an opening 78, and the locking member 76 is adjacent to the opening 78.

The first synchronization device 36 is detachably connected to the second rail 32 of the first rail assembly 22. Similarly, as shown in FIG. 2, the second synchronization device 200 is detachably connected to the second rail 32 of the second slide rail assembly 24. Furthermore, the housing 42 of the first synchronization device 36 and the second rail 32 have corresponding mounting features. In the present embodiment, the housing 42 has at least one first mounting feature 80, and the second rail 32 has at least one second mounting feature 82. For example, the at least one first mounting feature 80 and the at least one second mounting feature 82 can be a combination of a hook and a protrusion; Or, the at least one first mounting feature 80 and the at least one second mounting feature 82 can be a combination of a screw and a screw hole, such that the first synchronization device 36 can be mounted to or detached from the second rail 32 of the first rail assembly 22.

Figure 10:
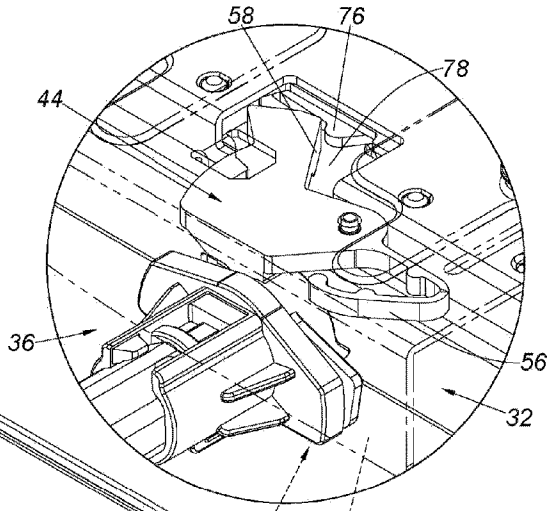
FIG. 10 is an enlarged view of an area A of FIG. 8.

As shown in FIG. 10, when the first synchronization device 36 is mounted to the second rail 32 of the first rail assembly 22, the driving member 44 of the first synchronization device 36 is adjacent to the opening 78 of the second rail 32 of the first rail assembly. The elastic feature 56 of the driving member 44 faces toward and contacts the second side plate 50 of the housing 42. On the other hand, the driving feature 58 of the driving member 44 faces toward and is adjacent to the locking member 76 of the opening mechanism 74.

Figure 11:
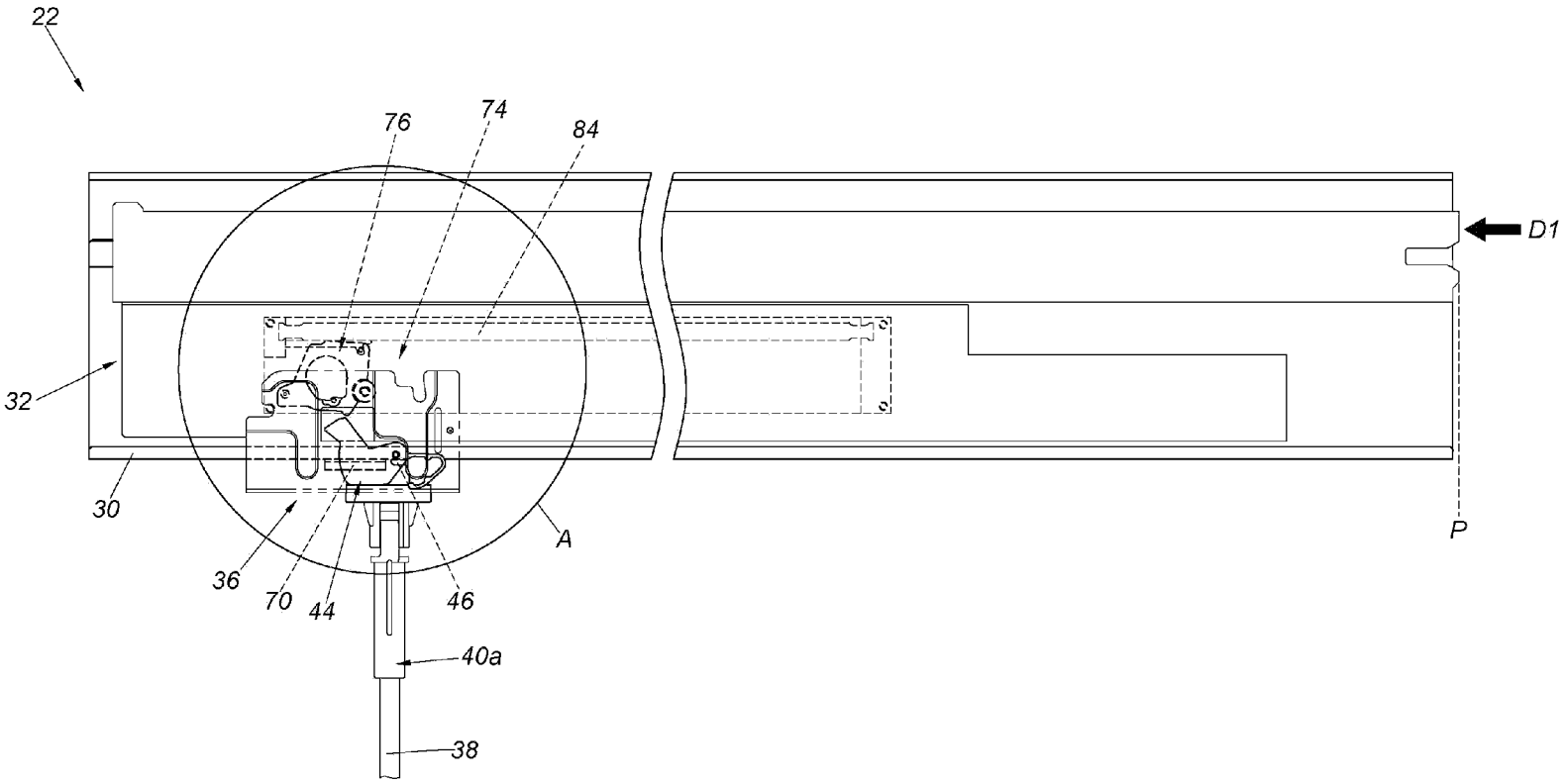
FIG. 11 is a diagram showing a second rail of the slide rail assembly located at a predetermined position relative to a first rail according to an embodiment of the present invention.
Figure 12:
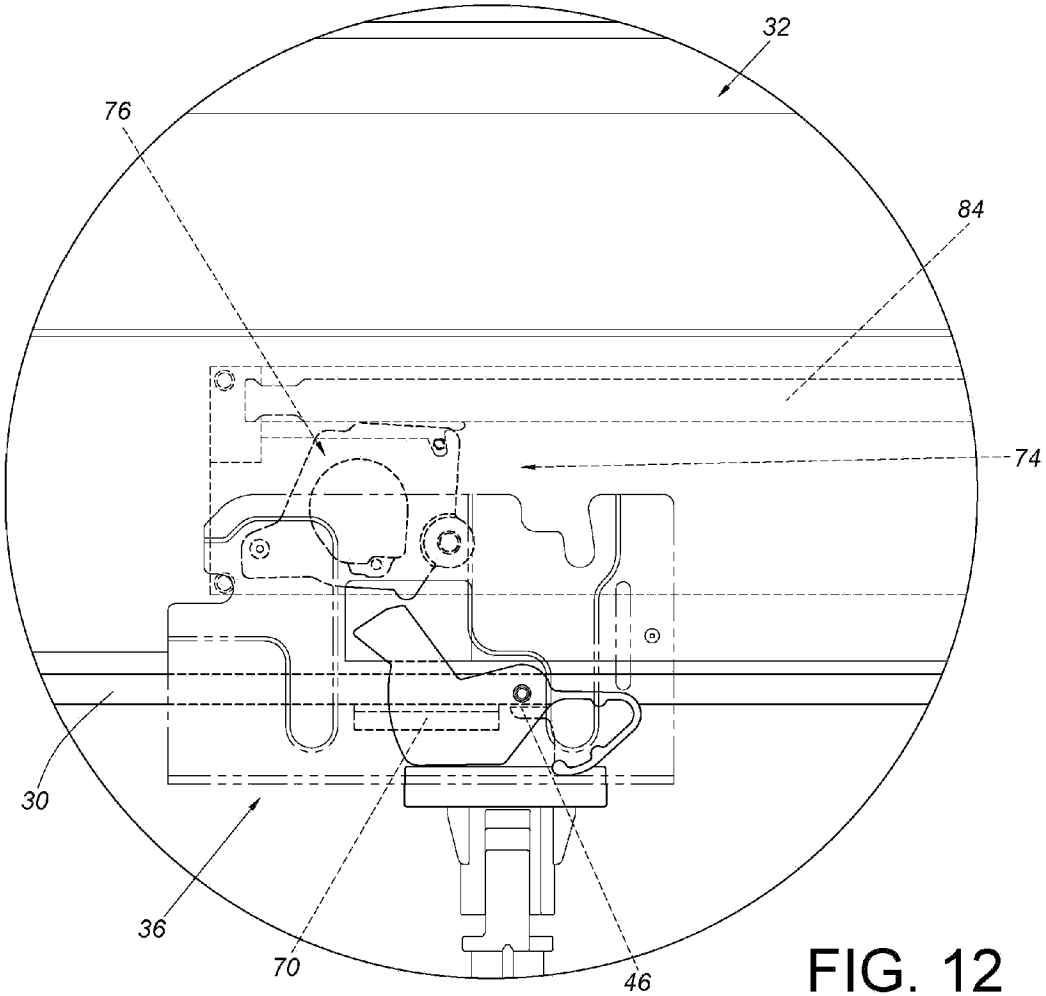
FIG. 12 is an enlarged view of an area A of FIG. 11.

As shown in FIG. 11 and FIG. 12, the opening mechanism 74 comprises an elastic member 84, such as a spring. The locking member 76 of the opening mechanism 74 is configured to temporarily lock the elastic member 84, so as to allow the elastic member 84 to accumulate an elastic force (such configuration is well known to those skilled in the art, for simplification, no further illustration is provided). When the second rail 32 is located at a predetermined position P (such as a retracted position) relative to the first rail 30, a user can apply a force to the second rail 32 along a first direction D1, in order to move the second rail 32 relative to the first rail 30 along the first direction D1.

Figure 13:
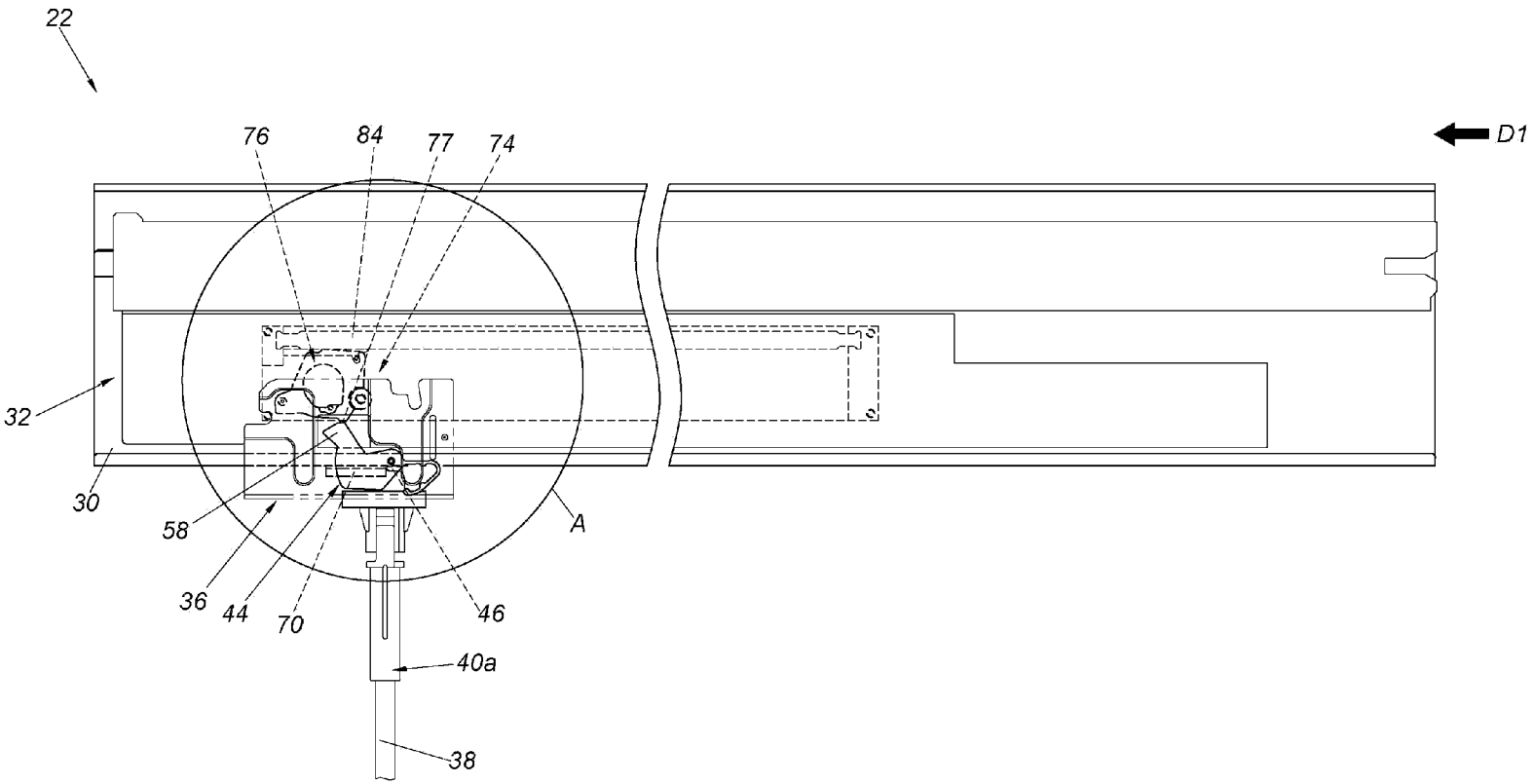
FIG. 13 is a diagram showing the second rail of the slide rail assembly being pushed to move relative to the first rail along a first direction according to an embodiment of the present invention.
Figure 14:
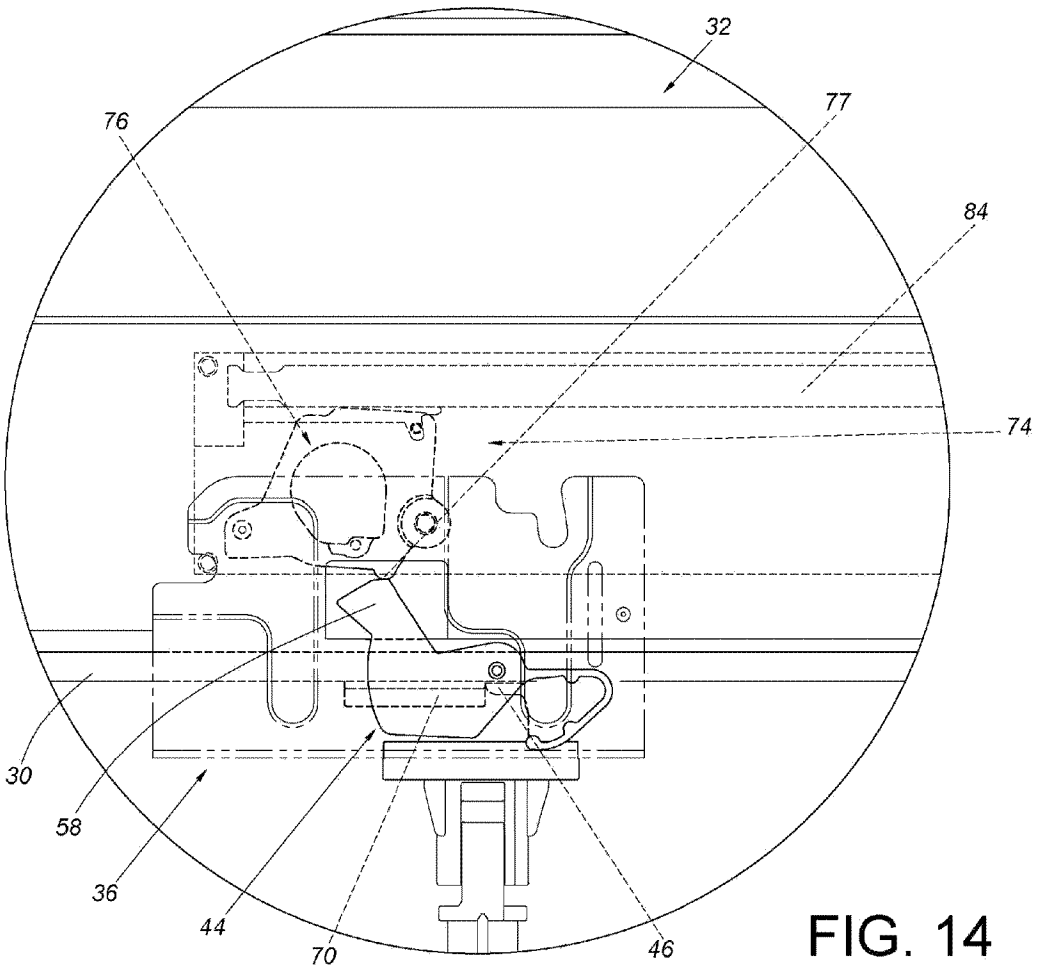
FIG. 14 is an enlarged view of an area A of FIG. 13.

As shown in FIG. 11, FIG. 13 and FIG. 14, during a process of the second rail 32 moving relative to the first rail 30 from the predetermined position P along the first direction D1, the first synchronization device 36 is configured to unlock the elastic member 84. In particular, the driving member 44 is configured to drive the locking member 76 to move for unlocking the elastic member 84 in response to the second rail 32 moving relative to the first rail 30 from the predetermined position P along the first direction D1. For example, the actuating member 46 of the first synchronization device 36 (only a portion of the actuating member 46, such as the portion where the force F is applied to in FIG. 5, is shown in the figures) abuts against the blocking feature 70 of the first rail 30 to generate an action force (such as the force F in FIG. 5), such that the actuating member 46 pushes the driving member 44 in response to the action force.

Figure 15:
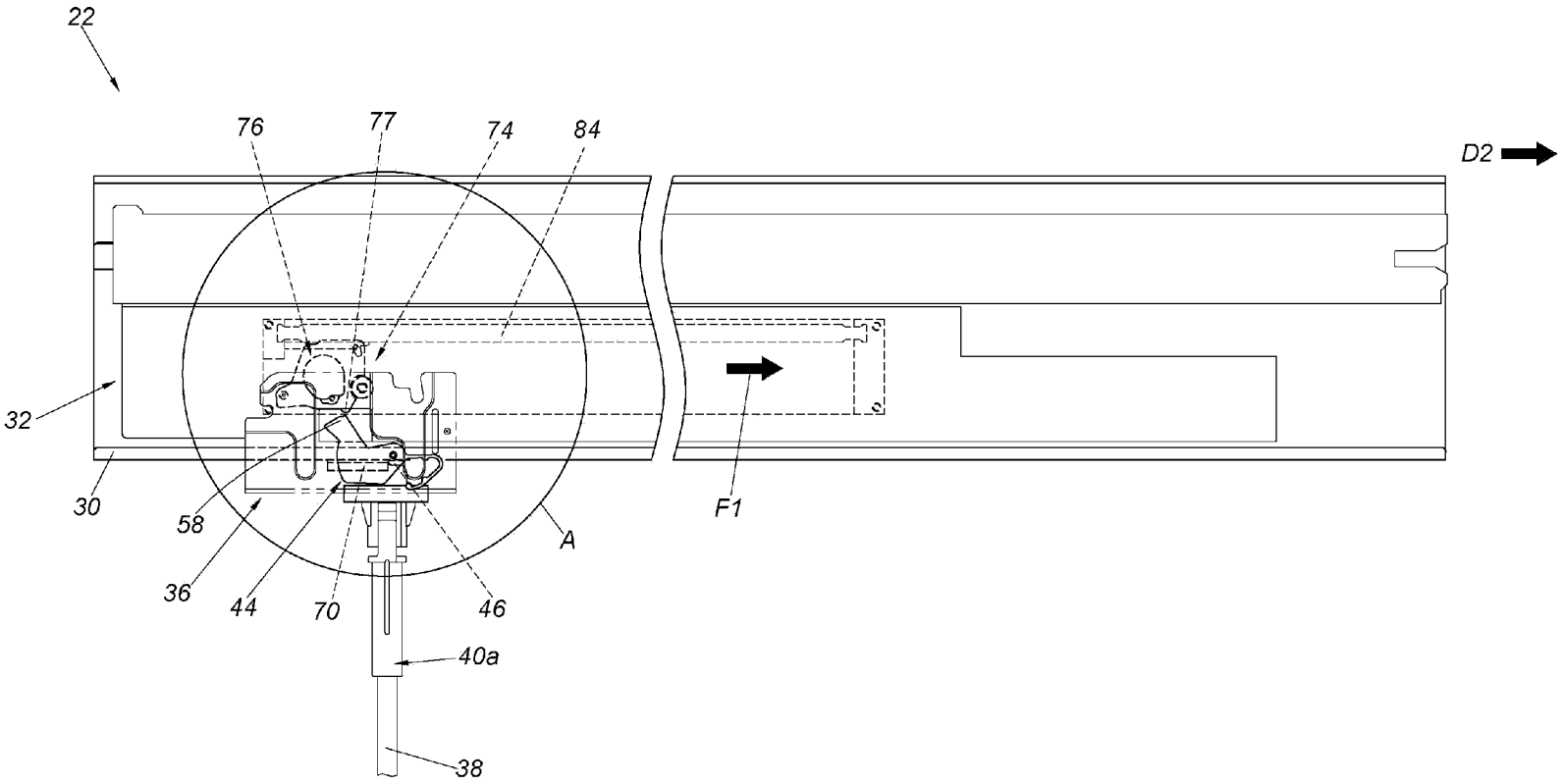
FIG. 15 is a diagram showing the second rail of the slide rail assembly being moved relative to the first rail along a second direction through releasing an elastic force of an elastic member according to an embodiment of the present invention.
Figure 16:
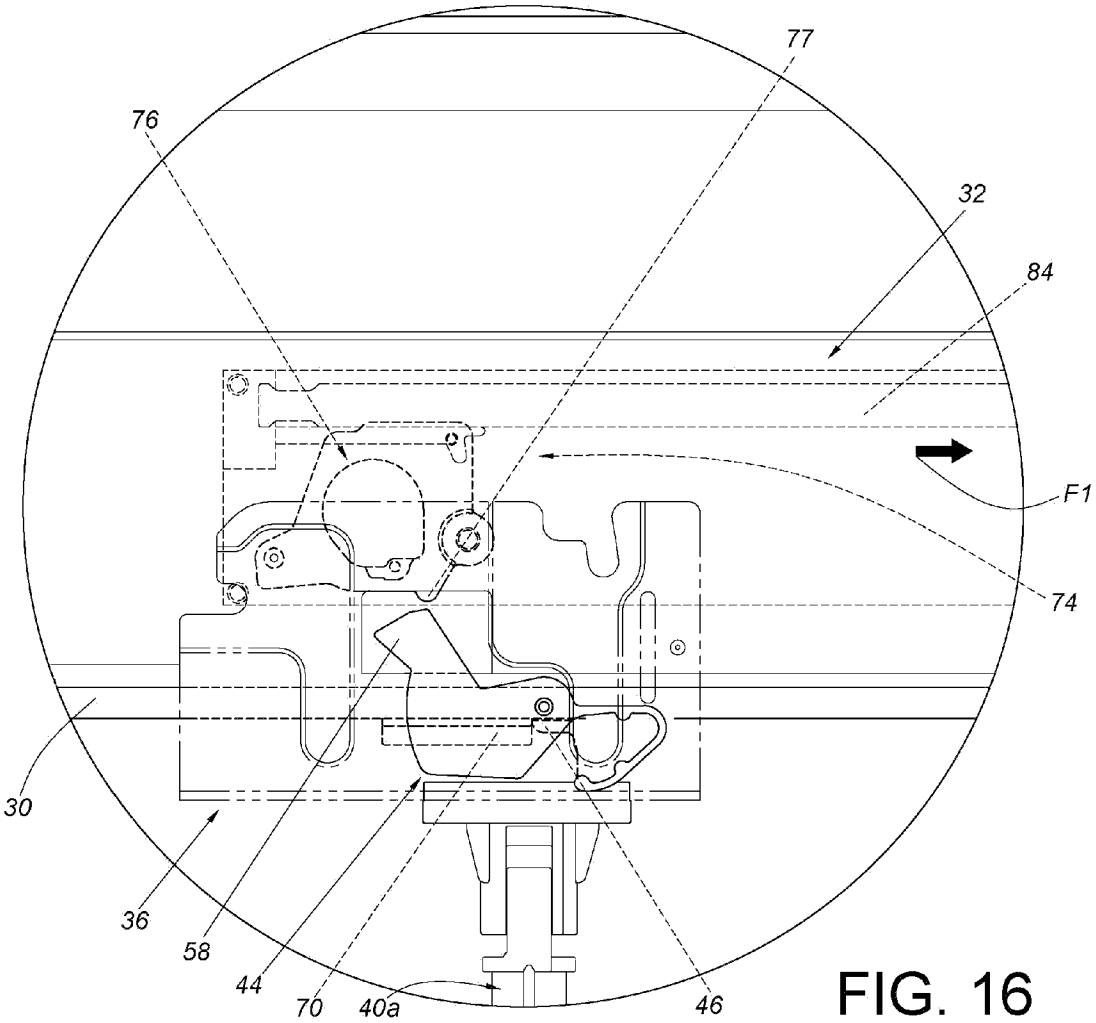
FIG. 16 is an enlarged view of an area A of FIG. 15.

As shown in FIG. 13, FIG. 15 and FIG. 16, after the actuating member 46 pushes the driving member 44, the driving member 44 is driven to move to be no longer in the initial state, such that the driving feature 58 of the driving member 44 can drive the locking member 76 to move through an unlocking part 77 of the locking member 76 (such as driving the locking member 76 to move away from a locking position) for unlocking the elastic member 84. As such, the elastic member 84 can release the elastic force F1 to be applied to the second rail 32 for driving the second rail 32 to move relative to the first rail 30 along a second direction D2 opposite to the first direction D1. Wherein, one of the driving feature 58 and the unlocking part 77 has an inclined surface or an arc surface to assist the driving member 44 in driving the locking member 76.

Figure 17:
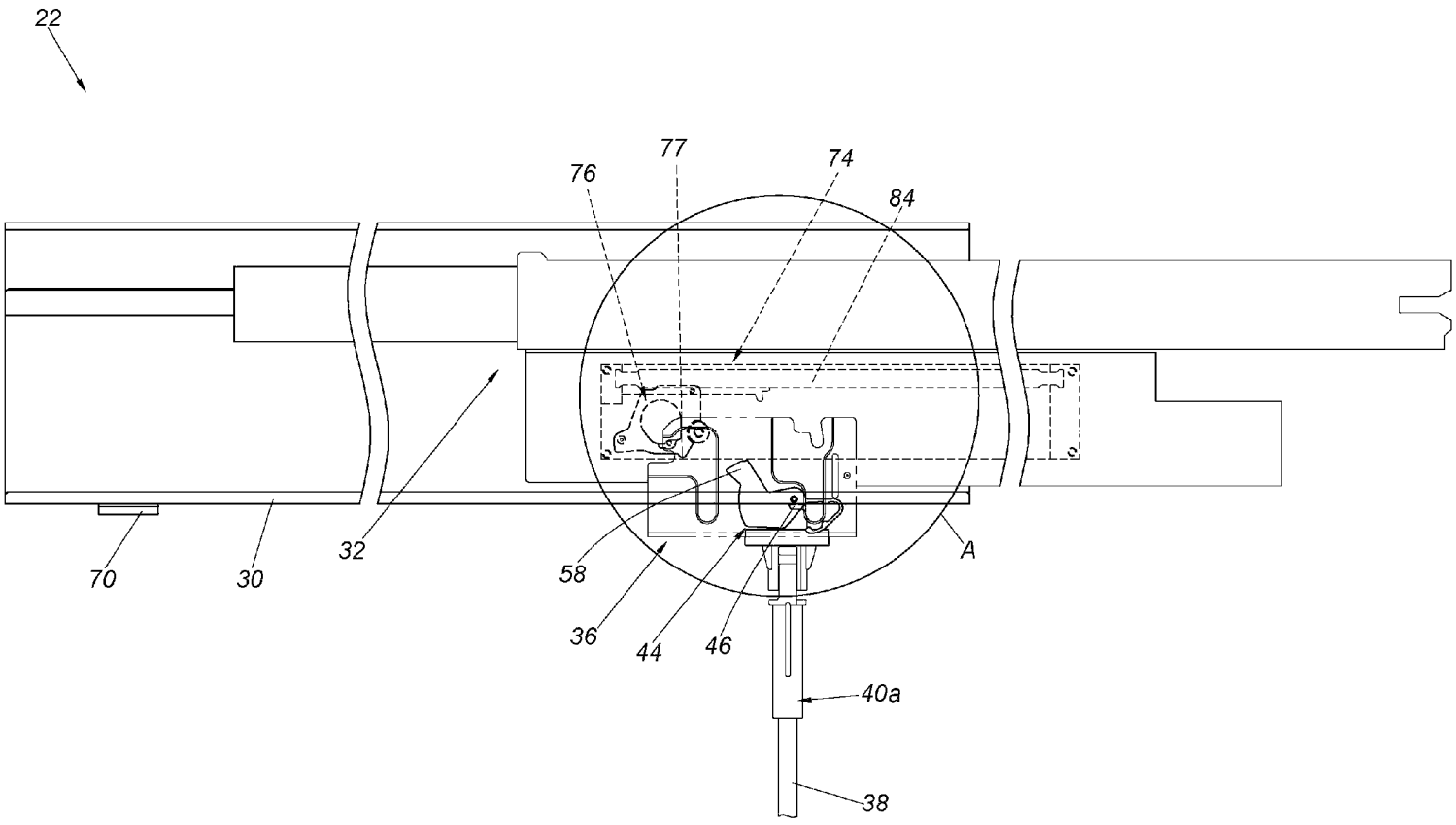
FIG. 17 is a diagram showing the second rail of the slide rail assembly being further moved relative to the first rail along the second direction according to an embodiment of the present invention.
Figure 18:
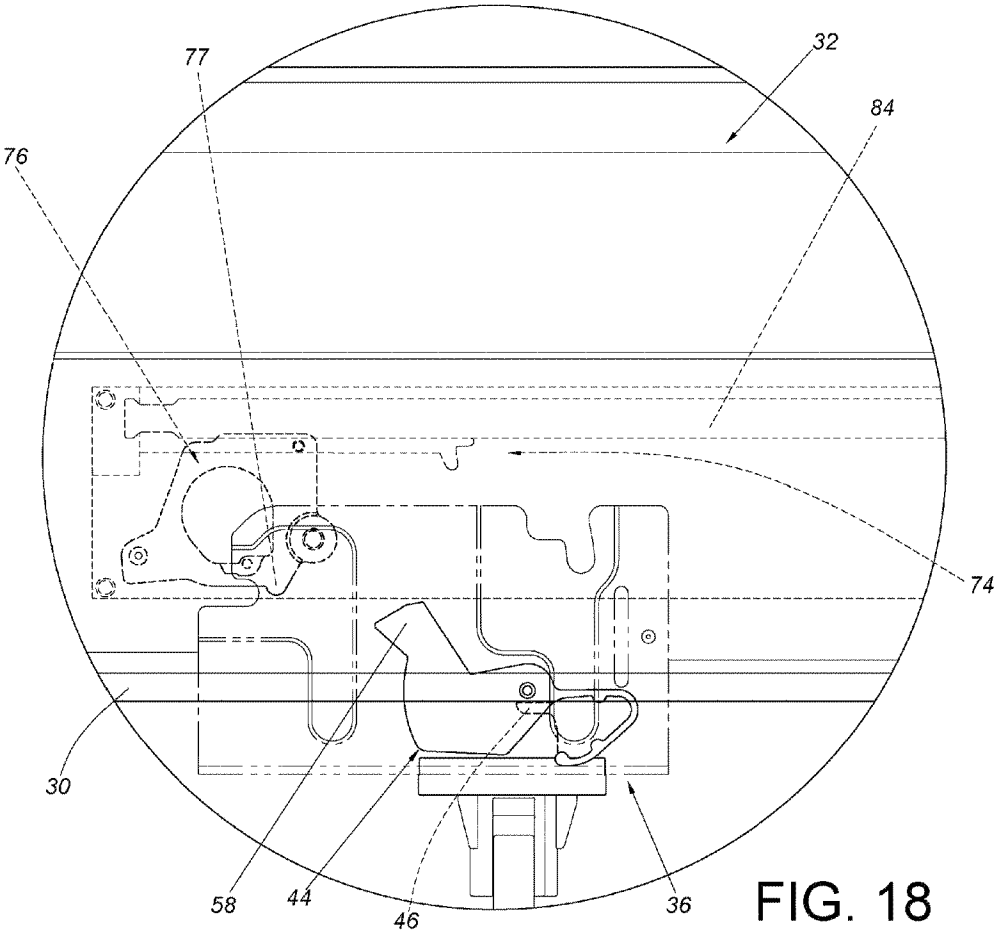
FIG. 18 is an enlarged view of an area A of FIG. 17.

As shown in FIG. 15, FIG. 17 and FIG. 18, after the elastic member 84 releases the elastic force F1 to be applied to the second rail 32, the second rail 32 is moved relative to the first rail 30 along the second direction D2 in response to the elastic force F1.

Figure 19:
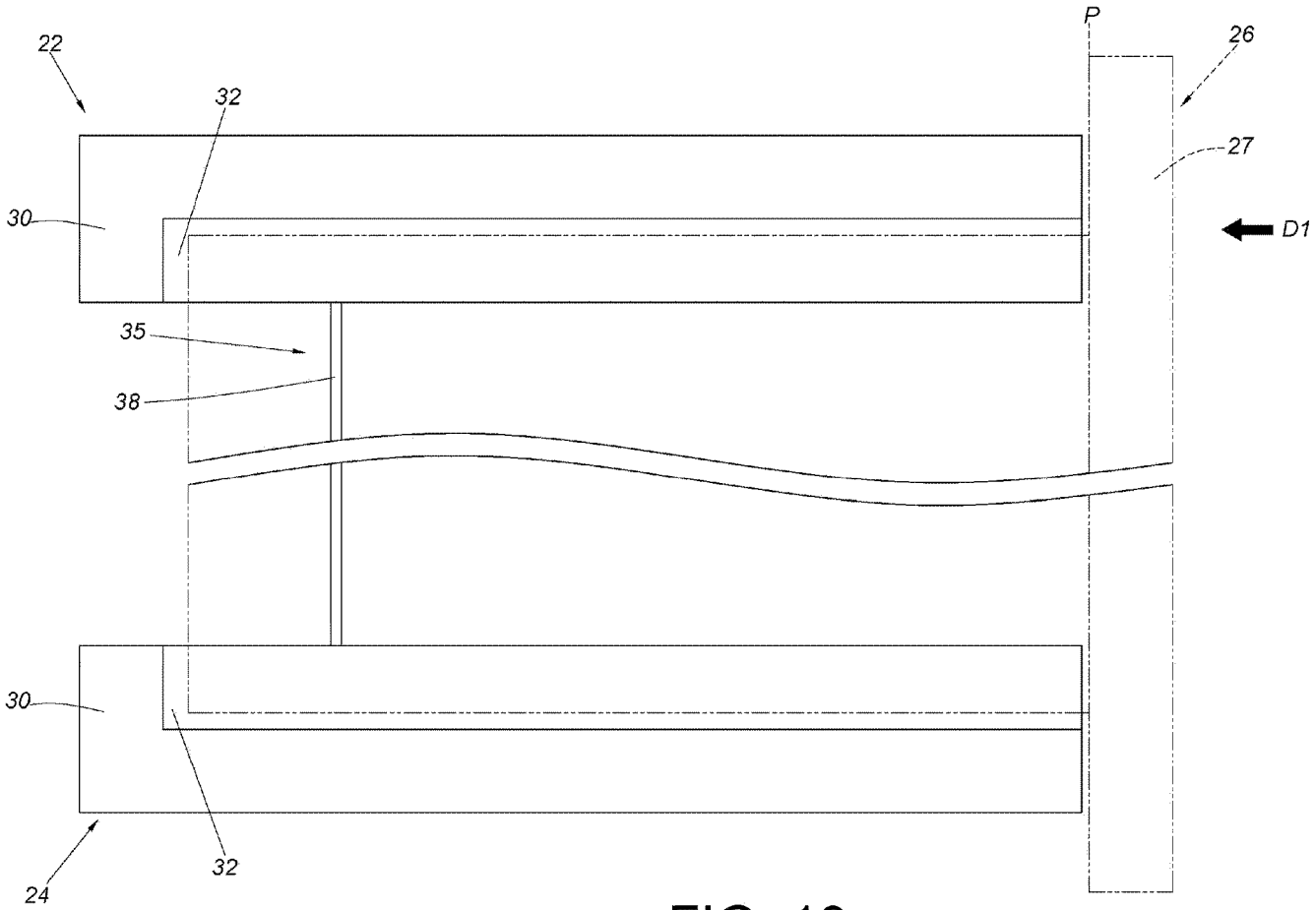
FIG. 19 is a diagram showing the first furniture part located at the predetermined position according to an embodiment of the present invention.
Figure 20:
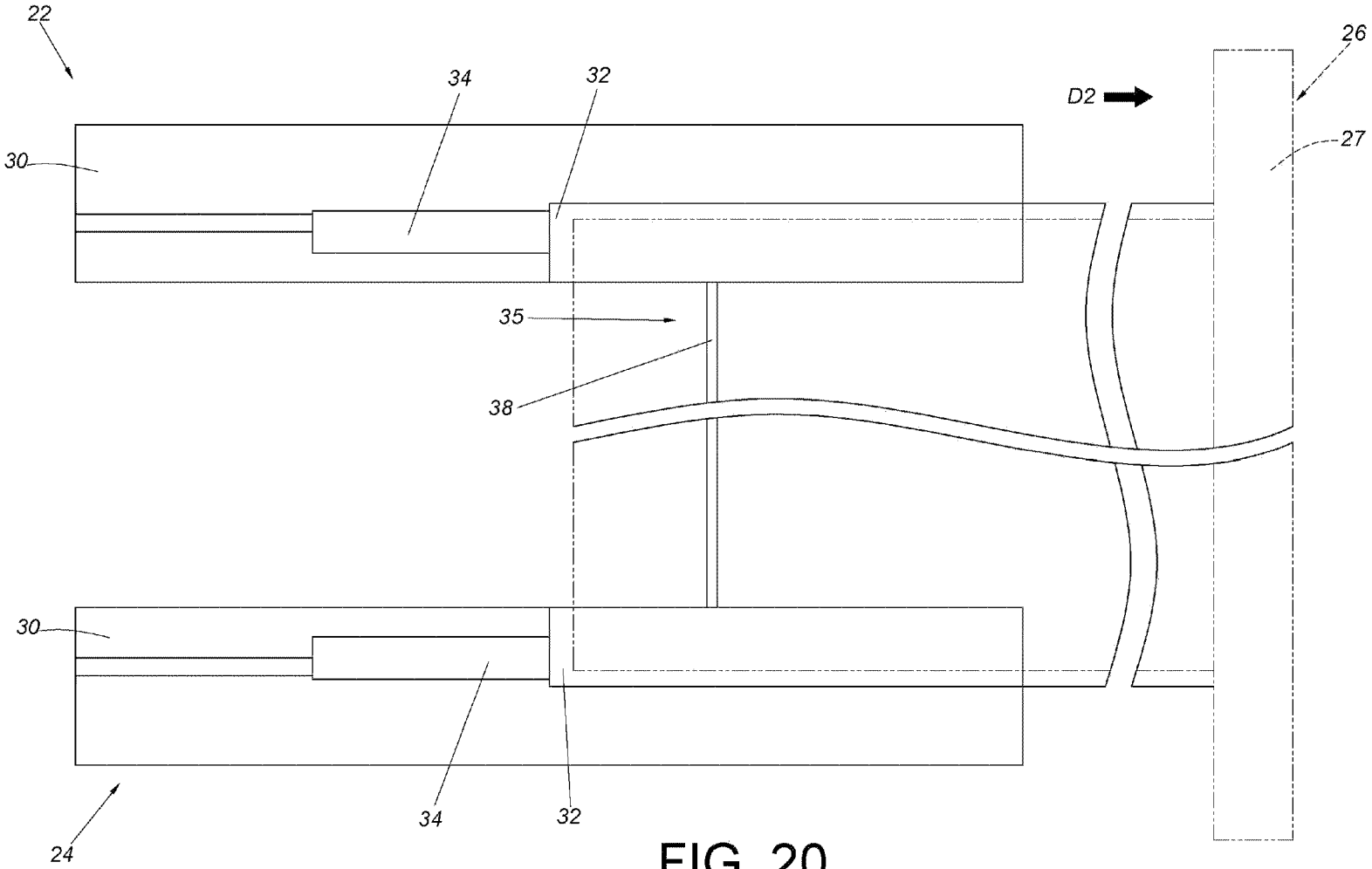
FIG. 20 is a diagram showing the first furniture part being moved along the second direction according to an embodiment of the present invention.

As shown in FIG. 19 and FIG. 20, when the first furniture part 26 is located at the predetermined position P, the user can apply a force along the first direction D1 to any position on the first furniture part 26, such that the first furniture part 26 can be moved relative to the first rail 30 of the first slide rail assembly 22 and the second slide rail assembly 24 along the first direction D1 through the second rails 32 of the first slide rail assembly 22 and the second slide rail assembly 24. Through releasing the elastic force F1 of the elastic member 84 of the opening mechanism 74, the first furniture part 26 can be ejected to move along the second direction D2. Wherein, the second rail 32 of the first slide rail assembly 22 and the second rail 32 of the second slide rail assembly 24 are connected through the synchronization rod 38 of the synchronization system 35 in order to be synchronously moved (please refer to FIG. 2 and related description for such operation, no further illustration is provided for simplification,). Therefore, when the user applies the force along the first direction D1 to any position, such as a left side or a right side on the first furniture part 26 (such as on a front panel 27 of the first furniture part 26), the first furniture part 26 (or the second rail 32) can be moved relative to the second furniture part 28 (or the first rail 30) from the predetermined position P (such as the retracted position) along the first direction D1, in order to drive the locking member 76 of the opening mechanism 74 to move for unlocking the elastic member 84. That is, through the synchronization rod 38, reliability of the push-open function of the first furniture part 26 relative to the second furniture part 28 can be improved.

Therefore, the synchronization system of the present invention is characterized in that:

1. The synchronization device 36, 200 is detachably connected to a slide rail (such as the second rail 32).
2. Two slide rails (such as the second rail 32 of the first slide rail assembly 22 and the second rail 32 of the second slide rail assembly 24) are connected through the synchronization rod 38 of the synchronization system 35 in order to be moved synchronously.
3. Through the synchronization rod 38, reliability of the push-open function of the first furniture part 26 relative to the second furniture part 28 can be improved.
4. The detachable design of the synchronization device of the present invention allows the user to additionally install the synchronization device according to use requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A synchronization system, applicable to a furniture system, the furniture system comprising a first slide rail assembly and a second slide rail assembly, each of the first slide rail assembly and the second slide rail assembly comprising a first rail and a second rail movable relative to the first rail, the synchronization system comprising:

a first synchronization device configured to be detachably connected to the first slide rail assembly of the furniture system;

a second synchronization device configured to be detachably connected to the second slide rail assembly of the furniture system;

a synchronization rod detachably mounted between the first synchronization device and the second synchronization device for allowing the second rail of the first slide rail assembly and the second rail of the second slide rail assembly to move synchronously; and an opening mechanism configured to be attached to the second rail of the first rail assembly, wherein the opening mechanism comprises an elastic member and a locking member configured to lock the elastic member, the first synchronization device comprises a housing and a driving member mounted to the housing, the driving member is configured to drive the locking member to move for unlocking the elastic member in response to the second rail moving relative to the first rail from a predetermined position along a first direction, in order to allow the elastic member to release an elastic force for driving the second rail of the first slide rail assembly and the second rail of the second slide rail assembly to move along a second direction opposite to the first direction.

2. The synchronization system of claim 1, wherein the driving member comprises an elastic feature, the driving member is held in an initial state relative to the housing in response to an elastic force of the elastic feature.

3. The synchronization system of claim 2, wherein the first synchronization device further comprises an actuating member, wherein during the process of the second rail moving relative to the first rail from the predetermined position along the first direction, the actuating member abuts against a portion of the first rail to generate an action force to be applied to the driving member, such that the driving member is no longer in the initial state and configured to drive the locking member in response to the action force.

4. The synchronization system of claim 3, wherein the housing comprises a first side plate and a second side plate connected to the first side plate, and the driving member and the actuating member are movably mounted to the first side plate and the second side plate respectively.

5. The synchronization system of claim 4, wherein the driving member and the actuating member are respectively pivoted to the first side plate and the second side plate, the driving member is movable relative to the first side plate within a limited range defined by a first limiting feature, and the actuating member is movable relative to the second side plate within a limited range defined by a second limiting feature.

6. The synchronization system of claim 5, wherein the first synchronization device further comprises a supporting base connected to the actuating member, the synchronization rod is detachably connected to the supporting base.

7. A furniture system, comprising:

a first slide rail assembly having a first rail and a second rail movable relative to the first rail; and a synchronization system, comprising:

a housing;

a driving member movable relative to the housing; and an opening mechanism attached to the second rail of the first slide rail assembly, comprising an elastic member and a locking member configured to temporarily lock the elastic member;

wherein the housing is detachably connected to the second rail;

wherein the driving member is configured to drive the locking member to move for unlocking the elastic member in response to the second rail moving relative to the first rail from a predetermined position along a first direction, in order to allow the elastic member to release an elastic force for driving the second rail to move relative to the first rail along a second direction.

8. The furniture system of claim 7, wherein the housing has at least one mounting feature corresponding to at least one mounting feature of the second rail.

9. The furniture system of claim 8, wherein the driving member further comprises an elastic feature, the driving member is held in an initial state relative to the housing in response to an elastic force of the elastic feature.

10. The furniture system of claim 9, further comprising an actuating member adjacent to the driving member, wherein the actuating member is configured to drive the driving member to be no longer in the initial state.

11. The furniture system of claim 10, wherein the housing comprises a first side plate and a second side plate bent relative to the first side plate, and the driving member and the actuating member are movably mounted to the first side plate and the second side plate respectively.

12. The furniture system of claim 11, wherein the driving member and the actuating member are respectively pivoted to the first side plate and the second side plate, the driving member is movable relative to the first side plate within a limited range defined by a first limiting feature, and the actuating member is movable relative to the second side plate within a limited range defined by a second limiting feature.

13. The furniture system of claim 10, further comprising a supporting base connected to the actuating member, and a synchronization rod detachably connected to the supporting base, wherein the furniture system further comprises a second slide rail assembly having a first rail and a second rail movable relative to the first rail of the second slide rail assembly, the second rail of the first slide rail assembly and the second rail of the second slide rail assembly are connected through the synchronization rod in order to be synchronously moved.

14. The furniture system of claim 7, wherein the furniture system further comprises a second slide rail assembly having a first rail and a second rail movable relative to the first rail of the second slide rail assembly, the second rail of the first slide rail assembly and the second rail of the second slide rail assembly are connected through a synchronization rod in order to be synchronously moved.

15. A synchronization device, comprising:

a housing configured to be mounted to a slide rail, wherein the slide rail comprises an opening mechanism, the opening mechanism comprises an elastic member and a locking member configured to lock the elastic member;

a driving member movable relative to the housing, the driving member configured to drive the locking member to move for unlocking the elastic member, in order to allow the elastic member to release an elastic force to be applied to the slide rail; and a synchronization rod mounted to the housing, wherein the housing is detachably connected to the slide rail, the synchronization device further comprises an elastic feature, the driving member is held in an initial state relative to the housing in response to an elastic force of the elastic feature.

16. The synchronization device of claim 15, further comprising an actuating member, wherein the actuating member is configured to drive the driving member to be no longer in the initial state, in order to further drive the locking member.

17. The synchronization device of claim 16, wherein the housing comprises a first side plate and a second side plate, the driving member and the actuating member are movably mounted to the first side plate and the second side plate respectively, the driving member is movable relative to the first side plate within a limited range defined by a first limiting feature, and the actuating member is movable relative to the second side plate within a limited range defined by a second limiting feature.

18. The synchronization device of claim 16, further comprising a supporting base connected to the actuating member, wherein the synchronization rod is mounted to the housing through the supporting base.

* * * * *